US009890339B2

(12) United States Patent
Subramaniyam

(10) Patent No.: US 9,890,339 B2
(45) Date of Patent: Feb. 13, 2018

(54) ADDITIVE FOR INHIBITING ACID CORROSION AND METHOD OF USING THE NEW ADDITIVE

(75) Inventor: Mahesh Subramaniyam, Mumbai (IN)

(73) Assignee: Dorf Ketal Chemicals (I) Private Limited, Mumbai (IN)

( * ) Notice: Subject to any disclaimer, the term of this patent is extended or adjusted under 35 U.S.C. 154(b) by 911 days.

(21) Appl. No.: 13/060,819

(22) PCT Filed: Aug. 25, 2009

(86) PCT No.: PCT/IB2009/053726

§ 371 (c)(1),
(2), (4) Date: May 18, 2011

(87) PCT Pub. No.: WO2010/023621

PCT Pub. Date: Mar. 4, 2010

(65) Prior Publication Data

US 2011/0214980 A1 Sep. 8, 2011

(30) Foreign Application Priority Data

Aug. 26, 2008 (IN) ..... 1790/MUM/2008

(51) Int. Cl.

| | |
|---|---|
| ***C08F 279/00*** | (2006.01) |
| ***C10G 75/02*** | (2006.01) |
| ***C10L 1/26*** | (2006.01) |
| ***C10L 10/04*** | (2006.01) |

(52) U.S. Cl.

CPC ..... *C10G 75/02* (2013.01); *C10L 1/2683* (2013.01); *C10L 10/04* (2013.01); *C10G 2300/4075* (2013.01)

(58) Field of Classification Search

None

See application file for complete search history.

(56) References Cited

U.S. PATENT DOCUMENTS

| | | | | |
|---|---|---|---|---|
| 1,872,091 | A | 8/1932 | Mougey | |
| 2,316,078 | A | 4/1943 | Loane et al. | |
| 2,316,087 | A | 4/1943 | Gaynor et al. | |
| 2,688,612 | A | 9/1954 | Watson | |
| 2,915,517 | A | 12/1959 | Le Suer | |
| 3,132,975 | A | 5/1964 | Freud et al. | |
| 3,145,886 | A | 8/1964 | Goodwin | |
| 3,201,438 | A | 8/1965 | Reed et al. | |
| 3,256,190 | A * | 6/1966 | Reed et al. | C07F 9/4075 508/423 |
| 3,260,622 | A | 7/1966 | Le Suer | |
| 3,281,359 | A | 10/1966 | Oberender et al. | |
| 3,324,032 | A | 6/1967 | O'Halloran | |
| 3,428,561 | A | 2/1969 | Lesuer | |
| 3,459,662 | A | 8/1969 | Hu | |
| 3,460,989 | A | 8/1969 | Rusch | |
| 3,489,682 | A | 1/1970 | Lesuer | |
| 3,531,394 | A | 9/1970 | Koszman | |
| 3,663,637 | A | 5/1972 | Juhl et al. | |
| 3,668,237 | A | 6/1972 | Cyba | |
| 3,904,535 | A * | 9/1975 | Gordon et al. | 508/224 |
| 3,909,447 | A | 9/1975 | Redmore et al. | |
| 4,024,049 | A | 5/1977 | Shell et al. | |
| 4,024,050 | A | 5/1977 | Shell et al. | |
| 4,105,540 | A | 8/1978 | Weinland | |
| 4,443,609 | A | 4/1984 | Oude Alink et al. | |
| 4,542,253 | A | 9/1985 | Kaplan et al. | |
| 4,578,178 | A | 3/1986 | Forester | |
| 4,600,518 | A | 7/1986 | Ries et al. | |
| 4,842,716 | A | 6/1989 | Kaplan et al. | |
| 4,906,391 | A | 3/1990 | Andress | |
| 4,927,561 | A | 5/1990 | Forester | |
| 4,941,994 | A | 7/1990 | Zetlmeisl et al. | |

(Continued)

FOREIGN PATENT DOCUMENTS

| | | |
|---|---|---|
| EP | 0565285 B1 | 5/1997 |
| EP | 1063276 A1 | 12/2000 |

(Continued)

OTHER PUBLICATIONS

Abou El Naga, H. H., et al., "Succinimide Phosphoric Acid Esters as Multipurpose Additives," XP002565966, Lubrication Science, Jul. 1994, pp. 351-361, vol. 6, No. 4.

Office Action (Final) dated May 22, 2014 (24 pages), U.S. Appl. No. 12/593,622, filed Sep. 29, 2009.

Foreign communication from a related counterpart application—Decision to Grant Patent, EP 09 787 015, dated Mar. 27, 2014, 48 pages.

International Search Report dated Jun. 17, 2010.

Office Action dated Apr. 3, 2014 (20 pages), U.S. Appl. No. 13/061,045, filed Feb. 25, 2011.

Advisory Action dated Aug. 8, 2013 (4 pages), U.S. Appl. No. 12/677,791, filed Mar. 11, 2010.

Foreign communication from a related counterpart application—International Search Report and Written Opinion, PCT/IN2008/000586, dated Aug. 24, 2009, 6 pages.

Foreign communication from a related counterpart application—International Preliminary Report on Patentability, PCT/IN2008/000586, dated Mar. 16, 2010, 5 pages.

(Continued)

*Primary Examiner* — Tanisha Diggs

(74) *Attorney, Agent, or Firm* — Conley Rose, P.C.; Rodney B. Carroll

(57) ABSTRACT

The present invention relates to the field of corrosion inhibition in hydrocarbon fluid processing units. The present invention comprises a new additive for inhibiting acid corrosion comprising polymeric thiophosphate ester, which is obtained by reaction of a polymer compound having mono, di or poly hydroxyl group, preferably polymer compound which is hydroxyl-termination, more preferably said polymer compound comprising hydroxyl-terminated polyisobutylene or polybutene and phosphorous pentasulphide. Said polymeric thiophosphate ester is further reacted with any oxide selected from group consisting of ethylene oxide, butylenes oxide or propylene oxide or such other oxide, preferably ethylene oxide, capably forming ethylene oxide derivative of thiophosphate ester. The invention is useful effecting acid corrosion inhibition on the metal surfaces of a distillation unit, distillation column, trays, packing and pump around piping.

22 Claims, No Drawings

(56) References Cited

U.S. PATENT DOCUMENTS

| | | | |
|---|---|---|---|
| 5,182,013 | A | 1/1993 | Petersen et al. |
| 5,252,254 | A | 10/1993 | Babaian-Kibala |
| 5,314,643 | A | 5/1994 | Edmondson et al. |
| 5,484,542 | A | 1/1996 | Cahoon et al. |
| 5,500,107 | A | 3/1996 | Edmondson |
| 5,552,085 | A | 9/1996 | Babaian-Kibala |
| 5,611,991 | A | 3/1997 | Naraghi |
| 5,630,964 | A | 5/1997 | Babaian-Kibala et al. |
| 5,725,611 | A | 3/1998 | Wright et al. |
| 5,863,415 | A | 1/1999 | Zetlmeisl |
| 6,512,133 | B1 | 1/2003 | Götzmann et al. |
| 6,902,662 | B2 | 6/2005 | Eaton et al. |
| 7,122,508 | B2 | 10/2006 | Boffa |
| 9,228,142 | B2 | 1/2016 | Subramaniyam |
| 2002/0107150 | A1 | 8/2002 | Mikami et al. |
| 2005/0044778 | A1 | 3/2005 | Orr |
| 2005/0234184 | A1 | 10/2005 | Doring et al. |
| 2007/0119747 | A1 | 5/2007 | Harrell et al. |
| 2010/0116718 | A1 | 5/2010 | Subramaniyam |
| 2010/0126842 | A1 | 5/2010 | Subramaniyam |
| 2010/0264064 | A1 | 10/2010 | Mahesh |
| 2011/0160405 | A1 | 6/2011 | Subramaniyam |

FOREIGN PATENT DOCUMENTS

| | | | |
|---|---|---|---|
| GB | 8667 | A | 1/1907 |
| GB | 792553 | | 3/1958 |
| WO | 2006049980 | A2 | 5/2006 |
| WO | WO 2008/005058 | A1 | 1/2008 |
| WO | 2008120236 | A3 | 10/2008 |
| WO | 2008122989 | A2 | 10/2008 |
| WO | 2008122989 | A4 | 10/2008 |
| WO | WO 2008/120236 | A2 | 10/2008 |
| WO | WO 2008/122989 | A3 | 10/2008 |
| WO | 2009063496 | A3 | 5/2009 |
| WO | WO 2009/063496 | A2 | 5/2009 |
| WO | 2010023621 | A2 | 3/2010 |
| WO | 2010023621 | A3 | 3/2010 |
| WO | 2010023628 | A1 | 3/2010 |

OTHER PUBLICATIONS

Foreign communication from a related counterpart application—International Search Report and Written Opinion, PCT/IB2009/053736, dated Feb. 9, 2010, 11 pages.
Foreign communication from a related counterpart application—International Preliminary Report on Patentability, PCT/IB2009/053736, dated Oct. 18, 2010, 20 pages.
Foreign communication from a related counterpart application—International Search Report and Written Opinion, PCT/IB2009/053726, dated Jun. 17, 2010, 15 pages.
Foreign communication from a related counterpart application—International Preliminary Report on Patentability, PCT/IB2009/053726, dated Dec. 7, 2010, 14 pages.
Foreign communication from a related counterpart application—International Search Report and Written Opinion, PCT/IN2008/000217, dated Mar. 23, 2009, 8 pages.
Foreign communication from a related counterpart application—International Preliminary Report on Patentability, PCT/IN2008/000217, dated Oct. 6, 2009, 7 pages.
Foreign communication from a related counterpart application—International Search Report and Written Opinion, PCT/IN2008/000195, dated Mar. 25, 2009, 7 pages.
Foreign communication from a related counterpart application—International Preliminary Report on Patentability, PCT/IN2008/000195, dated Oct. 6, 2009, 6 pages.
Office Action (Final) dated Mar. 19, 2013 (16 pages), U.S. Appl. No. 12/593,622, filed Sep. 29, 2009.
Office Action dated Jul. 23, 2012 (16 pages), U.S. Appl. No. 12/593,622, filed Sep. 29, 2009.
Office Action (Restriction Requirement) dated May 2, 2012 (7 pages), U.S. Appl. No. 12/593,622, filed Sep. 29, 2009.
Office Action (Final) dated Sep. 5, 2013 (13 pages), U.S. Appl. No. 13/061,045, filed Feb. 25, 2011.
Office Action dated Jan. 29, 2013 (40 pages), U.S. Appl. No. 13/061,045, filed Feb. 25, 2011.
Office Action (Restriction Requirement) dated Dec. 7, 2012 (7 pages), U.S. Appl. No. 13/061,045, filed Feb. 25, 2011.
Office Action (Final) dated May 13, 2013 (12 pages), U.S. Appl. No. 12/594,320, filed Oct. 1, 2009.
Office Action dated Aug. 13, 2012 (15 pages), U.S. Appl. No. 12/594,320, filed Oct. 1, 2009.
Office Action (Restriction Requirement) dated Mar. 8, 2012 (9 pages), U.S. Appl. No. 12/594,320, filed Oct. 1, 2009.
Office Action (Final) dated May 23, 2013 (12 pages), U.S. Appl. No. 12/677,791, filed Mar. 11, 2010.
Office Action dated Nov. 15, 2012 (14 pages), U.S. Appl. No. 12/677,791, filed Mar. 11, 2010.
Office Action (Restriction Requirement) dated Jul. 26, 2012 (6 pages), U.S. Appl. No. 12/677,791, filed Mar. 11, 2010.
Office Action dated Oct. 11, 2013 (17 pages), U.S. Appl. No. 12/593,622, filed Sep. 29, 2009.
Office Action (Final) dated Sep. 11, 2014 (22 pages), U.S. Appl. No. 13/061,045, filed Feb. 25, 2011.
Office Action dated Mar. 31, 2015 (17 pages), U.S. Appl. No. 13/061,045, filed Feb. 25, 2011.
Office Action (Final) dated Nov. 9, 2015 (8 pages), U.S. Appl. No. 13/061,045, filed Feb. 25, 2011.
Office Action dated Jun. 9, 2016 (14 pages), U.S. Appl. No. 13/061,045, filed Feb. 25, 2011.
Office Action (Final) dated Jan. 18, 2017 (9 pages), U.S. Appl. No. 13/061,045, filed Feb. 25, 2011.
Office Action dated Aug. 11, 2017 (26 pages), U.S. Appl. No. 13/061,045, filed Feb. 25, 2011.

* cited by examiner

ADDITIVE FOR INHIBITING ACID CORROSION AND METHOD OF USING THE NEW ADDITIVE

CROSS-REFERENCE TO RELATED APPLICATIONS

This Application is a U.S. national phase application filed under 35 U.S.C. § 371 of International Application No. PCT/IB2009/053726, filed Aug. 25, 2009, designating the United States, which claims priority from Indian Patent Application No.: 1790/MUM/2008, filed Aug. 26, 2008, which are hereby incorporated herein by reference in their entirety for all purposes.

FIELD OF THE INVENTION

The present invention relates to the inhibition of metal corrosion in acidic hot hydrocarbons and particularly to the inhibition of corrosion of iron-containing metals in hot acidic hydrocarbons, especially when the acidity is derived from the presence of naphthenic acid and more particularly to an effective polymeric additive to effect corrosion inhibition and a method of using the same.

DISCUSSION OF PRIOR ART

It is widely known in the art that the processing of crude oil and its various fractions have led to damage to piping and other associated equipment due to naphthenic acid corrosion. These are corrosive to the equipment used to distill, extract, transport and process the crudes. Generally speaking, naphthenic acid corrosion occurs when the crude being processed has a neutralization number or total acid number (TAN), expressed as the milligrams of potassium hydroxide required to neutralize the acids in a one gram sample, above 0.2. It is also known that naphthenic acid-containing hydrocarbon is at a temperature between about 200° C. and 400° C. (approximately 400° F.-750° F.), and also when fluid velocities are high or liquid impinges on process surfaces e.g. in transfer lines, return bends and restricted flow areas.

Corrosion problems in petroleum refining operations associated with naphthenic acid constituents and sulfur compounds in crude oils have been recognized for many years. Such corrosion is particularly severe in atmospheric and vacuum distillation units at temperatures between 400° F. and 790° F. Other factors that contribute to the corrosivity of crudes containing naphthenic acids include the amount of naphthenic acid present, the concentration of sulfur compounds, the velocity and turbulence of the flow stream in the units, and the location in the unit (e.g., liquid/vapor interface).

As commonly used, naphthenic acid is a collective term for certain organic acids present in various crude oils. Although there may be present minor amounts of other organic acids, it is understood that the majority of the acids in naphthenic based crude are naphthenic in character, i.e., with a saturated ring structure as follows:

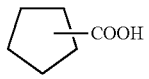

The molecular weight of naphthenic acid can extend over a large range. However, the majority of the naphthenic acid from crude oils is found in gas oil and light lubricating oil.

When hydrocarbons containing such naphthenic acid contact iron-containing metals, especially at elevated temperatures, severe corrosion problems arise.

Naphthenic acid corrosion has plagued the refining industry for many years. This corroding material consists of predominantly monocyclic or bicyclic carboxylic acids with a boiling range between 350° and 650° F. These acids tend to concentrate in the heavier fractions during crude distillation. Thus, locations such as the furnace tubing, transfer lines, fractionating tower internals, feed and reflux sections of columns, heat exchangers, tray bottoms and condensers are primary sites of attack for naphthenic acid. Additionally, when crude stocks high in naphthenic acids are processed, severe corrosion can occur in the carbon steel or ferritic steel furnace tubes and tower bottoms. Recently interest has grown in the control of this type of corrosion in hydrocarbon processing units due to the presence of naphthenic acid in crudes from locations such as China, India, Africa and Europe.

Crude oils are hydrocarbon mixtures which have a range of molecular structures and consequent range of physical properties. The physical properties of naphthenic acids which may be contained in the hydrocarbon mixtures also vary with the changes in molecular weight, as well as the source of oil containing the acid. Therefore, characterization and behavior of these acids are not well understood. A well known method used to "quantify" the acid concentration in crude oil has been a KOH titration of the oil. The oil is titrated with KOH, a strong base, to an end point which assures that all acids in the sample have been neutralized. The unit of this titration is mg. of KOH/g of sample and is referred to as the "Total Acid Number" (TAN) or Neutralization Number. Both terms are used interchangeably in the application.

The unit of TAN is commonly used since it is not possible to calculate the acidity of the oil in terms of moles of acid, or any other of the usual analytical terms for acid content. Refiners have used TAN as a general guideline for predicting naphthenic acid corrosion. For example, many refineries blend their crude to a TAN=0.5 assuming that at these concentrations naphthenic acid corrosion will not occur. However, this measure has been unsuccessful in preventing corrosion by naphthenic acid.

Naphthenic acid corrosion is very temperature dependent. The generally accepted temperature range for this corrosion is between 205° C. and 400° C. (400° F. and 750° F.). Corrosion attack by these acids below 205° C. has not yet been reported in the published literature. As to the upper boundary, data suggests that corrosion rates reach a maximum at about 600°-700° F. and then begin to diminish.

The concentration and velocity of the acid/oil mixture are also important factors which influence naphthenic acid corrosion. This is evidenced by the appearance of the surfaces affected by naphthenic acid corrosion. The manner of corrosion can be deduced from the patterns and color variations in the corroded surfaces. Under some conditions, the metal surface is uniformly thinned. Thinned areas also occur when condensed acid runs down the wall of a vessel. Alternatively, in the presence of naphthenic acid pitting occurs, often in piping or at welds. Usually the metal outside the pit is covered with a heavy, black sulfide film, while the surface of the pit is bright metal or has only a thin, grey to black film covering it. Moreover, another pattern of corrosion is erosion-corrosion, which has a characteristic pattern of gouges with sharp edges. The surface appears clean, with no visible by-products. The pattern of metal corrosion is indicative of the fluid flow within the system, since increased contact with surfaces allows for a greater amount of corrosion to take place. Therefore, corrosion patterns provide information as to the method of corrosion which has taken place. Also, the more complex the corrosion, i.e., in increasing complexity from uniform to pitting to erosion-corrosion, the lower is the TAN value which triggers the behavior.

The information provided by corrosion patterns indicates whether naphthenic acid is the corroding agent, or rather if the process of corrosion occurs as a result of attack by sulfur. Most crude contain hydrogen sulfide, and therefore readily form iron sulfide films on carbon steel. In all cases that have been observed in the laboratory or in the field, metal surfaces have been covered with a film of some sort. In the presence of hydrogen sulfide the film formed is invariably iron sulfide, while in the few cases where tests have been run in sulfur free conditions, the metal is covered with iron oxide, as there is always enough water or oxygen present to produce a thin film on the metal coupons.

Tests utilized to determine the extent of corrosion may also serve as indicators of the type of corrosion occurring within a particular hydrocarbon treating unit. Metal coupons can be inserted into the system. As they are corroded, they lose material. This weight loss is recorded in units of mg/cm.sup.2. Thereafter, the corrosion rate can be determined from weight loss measurements. Then the ratio of corrosion rate to corrosion product (mpy/mg/cm.sup.2) is calculated. This is a further indicator of the type of corrosion process which has taken place, for if this ratio is less than 10, it is well known that there is little or no contribution of naphthenic acid to the corrosion process. However, if the ratio exceeds 10, then naphthenic acid is a significant contributor to the corrosion process.

Distinguishing between sulfidation attack and corrosion caused by naphthenic acid is important, since different remedies are required depending upon the corroding agent. Usually, retardation of corrosion caused by sulfur compounds at elevated temperatures is effected by increasing the amount of chromium in the alloy which is used in the hydrocarbon treating unit. A range of alloys may be employed, from 1.25% Cr to 12% Cr, or perhaps even higher. Unfortunately, these show little to no resistance to naphthenic acid. To compensate for the corroding effects of sulfur and naphthenic acid, an austenitic stainless steel which contains at least 2.5% molybdenum, must be utilized. The corrosive problem is known to be aggravated by the elevated temperatures necessary to refine and crack the oil and by the oil's acidity which is caused primarily by high levels of naphthenic acid indigenous to the crudes. Naphthenic acid is corrosive in the range of about 175° C. to 420° C. At the higher temperatures the naphthenic acids are in the vapor phase and at the lower temperatures the corrosion rate is not serious. The corrosivity of naphthenic acids appears to be exceptionally serious in the presence of sulfide compounds, such as hydrogen sulfide, mercaptans, elemental sulfur, sulfides, disulfides, polysulfides and thiophenols. Corrosion due to sulfur compounds becomes significant at temperatures as low as 450° F. The catalytic generation of hydrogen sulfide by thermal decomposition of mercaptans has been identified as a cause of sulfidic corrosion.

Sulfur in the crudes, which produces hydrogen sulfide at higher temperatures, also aggravates the problem. The temperature range of primary interest for this type of corrosion is in the range of about 175° C. to about 400° C., especially about 205° C. to about 400° C.

Various approaches to controlling naphthenic acid corrosion have included neutralization and/or removal of naphthenic acids from the crude being processed; blending low acid number oils with corrosive high acid number oils to reduce the overall neutralization number; and the use of relatively expensive corrosion-resistant alloys in the construction of the piping and associated equipment. These attempts are generally disadvantageous in that they require additional processing and/or add substantial costs to treatment of the crude oil. Alternatively, various amine and amide based corrosion inhibitors are commercially available, but these are generally ineffective in the high temperature environment of naphthenic acid corrosion. Naphthenic acid corrosion is readily distinguished from conventional fouling problems such as coking and polymer deposition which can occur in ethylene cracking and other hydrocarbon processing reactions using petroleum based feedstocks. Naphthenic acid corrosion produces a characteristic grooving of the metal in contact with the corrosive stream. In contrast, coke deposits generally have corrosive effects due to carburization, erosion and metal dusting.

Because these approaches have not been entirely satisfactory, the accepted approach in the industry is to construct the distillation unit, or the portions exposed to naphthenic acid/sulfur corrosion, with the resistant metals such as high quality stainless steel or alloys containing higher amounts of chromium and molybdenum. The installation of corrosion-resistant alloys is capital intensive, as alloys such as 304 and 316 stainless steels are several times the cost of carbon steel. However, in units not so constructed there is a need to provide inhibition treatment against this type of corrosion. The prior art corrosion inhibitors for naphthenic acid environments include nitrogen-based filming corrosion inhibitors. However, these corrosion inhibitors are relatively ineffective in the high temperature environment of naphthenic acid oils.

While various corrosion inhibitors are known in various arts, the efficacy and usefulness of any particular corrosion inhibitor is dependent on the particular circumstances in which it is applied. Thus, efficacy or usefulness under one set of circumstances often does not imply the same for another set of circumstances. As a result, a large number of corrosion inhibitors have been developed and are in use for application to various systems depending on the medium treated, the type of surface that is susceptible to the corrosion, the type of corrosion encountered, and the conditions to which the medium is exposed. For example, U.S. Pat. No. 3,909,447 describes certain corrosion inhibitors as useful against corrosion in relatively low temperature oxygenated aqueous systems such as water floods, cooling towers, drilling muds, air drilling and auto radiator systems. That patent also notes that many corrosion inhibitors capable of performing in non-aqueous systems and/or non-oxygenated systems perform poorly in aqueous and/or oxygenated systems. The reverse is true as well. The mere fact that an inhibitor that has shown efficacy in oxygenated aqueous systems does not suggest that it would show efficacy in a hydrocarbon. Moreover, the mere fact that an inhibitor has been efficacious at relatively low temperatures does not indicate that it would be efficacious at elevated temperatures. In fact, it is common for inhibitors that are very effective at relatively low temperatures to become ineffective at temperatures such as the 175° C. to 400° C. encountered in oil refining. At such temperatures, corrosion is notoriously troublesome and difficult to alleviate. Thus, U.S. Pat. No. 3,909,447 contains no teaching or suggestion that it would be effective in non-aqueous systems such as hydrocarbon fluids, especially hot hydrocarbon fluids. Nor is there any indication in U.S. Pat. No. 3,909,447 that the compounds disclosed therein would be effective against naphthenic acid corrosion under such conditions.

Atmospheric and vacuum distillation systems are subject to naphthenic acid corrosion when processing certain crude oils. Currently used treatments are thermally reactive at use temperatures. In the case of phosphorus-based inhibitors, this is thought to lead to a metal phosphate surface film. The film is more resistant to naphthenic acid corrosion than the base steel. These inhibitors are relatively volatile and exhibit fairly narrow distillation ranges. They are fed into a column above or below the point of corrosion depending on the temperature range. Polysulfide inhibitors decompose into complex mixtures of higher and lower polysulfides and, perhaps, elemental sulfur and mercaptans. Thus, the volatility and protection offered is not predictable.

The problems caused by naphthenic acid corrosion in refineries and the prior art solutions to that problem have been described at length in the literature, the following of which are representative:

U.S. Pat. No. 3,531,394 to Koszman described the use of phosphorus and/or bismuth compounds in the cracking zone of petroleum steam furnaces to inhibit coke formation on the furnace tube walls.

U.S. Pat. No. 3,531,394 to Koszman described the use of phosphorus and/or bismuth compounds in the cracking zone of petroleum steam furnaces to inhibit coke formation on the furnace tube walls.

U.S. Pat. No. 4,024,049 to Shell et al discloses compounds for use as refinery antifoulants. While effective as antifoulant materials, materials of this type have not been used as corrosion inhibitors in the manner set forth therein. While this reference teaches the addition of thiophosphate esters such as those used in the subject invention to the incoming feed, due to the non-volatile nature of the ester materials they do not distill into the column to protect the column, the pumparound piping, or further process steps. The patent document reports that injecting the thiophosphate esters as taught therein results in prevention of the occurrence of naphthenic acid corrosion in distillation columns, pumparound piping, and associated equipment.

U.S. Pat. No. 4,105,540 to Weinland describes phosphorus containing compounds as antifoulant additives in ethylene cracking furnaces. The phosphorus compounds employed are mono- and di-ester phosphate and phosphite compounds having at least one hydrogen moiety complexed with an amine.

U.S. Pat. No. 4,443,609 discloses certain tetrahydrothiazole phosphonic acids and esters as being useful as acid corrosion inhibitors. Such inhibitors can be prepared by reacting certain 2,5-dihydrothiazoles with a dialkyl phosphite. While these tetrahydrothiazole phosphonic acids or esters have good corrosion and inhibition properties, they tend to break down during high temperature applications thereof with possible emission of obnoxious and toxic substances.

It is also known that phosphorus-containing compounds impair the function of various catalysts used to treat crude oil, e.g., in fixed-bed hydrotreaters and hydrocracking units. Crude oil processors are often in a quandary since if the phosphite stabilizer is not used, then iron can accumulate in the hydrocarbon up to 10 to 20 ppm and impair the catalyst. Although nonphosphorus-containing inhibitors are commercially available, they are generally less effective than the phosphorus-containing compounds.

U.S. Pat. No. 4,542,253 to Kaplan et al, described an improved method of reducing fouling and corrosion in ethylene cracking furnaces using petroleum feedstocks including at least 10 ppm of a water soluble mine complexed phosphate, phosphite, thiophosphate or thiophosphite ester compound, wherein the amine has a partition coefficient greater than 1.0 (equal solubility in both aqueous and hydrocarbon solvents).

U.S. Pat. No. 4,842,716 to Kaplan et al describes an improved method for reducing fouling and corrosion at least 10 ppm of a combination of a phosphorus antifoulant compound and a filming inhibitor. The phosphorus compound is a phosphate, phosphite, thiophosphate or thiophosphite ester compound. The filming inhibitor is an imidazoline compound.

U.S. Pat. No. 4,941,994 Zetmeisl et al discloses a naphthenic acid corrosion inhibitor comprising a dialkyl or trialkylphosphite in combination with an optional thiazoline.

A significant advancement in phosphorus-containing naphthenic acid corrosion inhibitors was reported in U.S. Pat. No. 4,941,994. Therein it is disclosed that metal corrosion in hot acidic liquid hydrocarbons is inhibited by the presence of a corrosion inhibiting amount of a dialkyl and/or trialkyl phosphite with an optional thiazoline.

While the method described in U.S. Pat. No. 4,941,994 provides significant improvements over the prior art techniques, nevertheless, there is always a desire to enhance the ability of corrosion inhibitors while reducing the amount of phosphorus-containing compounds which may impair the function of various catalysts used to treat crude oil, as well as a desire for such inhibitors that may be produced from lower cost or more available starting materials.

Another approach to the prevention of naphthenic acid corrosion is the use of a chemical agent to form a barrier between the crude and the equipment of the hydrocarbon processing unit. This barrier or film prevents corrosive agents from reaching the metal surface, and is generally a hydrophobic material. Gustavsen et al. NACE Corrosion 89 meeting, paper no. 449, Apr. 17-21, 1989 details the requirements for a good filming agent. U.S. Pat. No. 5,252,254 discloses one such film forming agent, sulfonated alkyl-substituted phenol, and effective against naphthenic acid corrosion.

U.S. Pat. No. 5,182,013 issued to Petersen et al. on Jan. 26, 1993 describes another method of inhibiting naphthenic acid corrosion of crude oil, comprising introducing into the oil an effective amount of an organic polysulfide. The disclosure of U.S. Pat. No. 5,182,013 is incorporated herein by reference. This is another example of a corrosion-inhibiting sulfur species. Sulfidation as a source of corrosion was detailed above. Though the process is not well understood, it has been determined that while sulfur can be an effective anti-corrosive agent in small quantities, at sufficiently high concentrations, it becomes a corrosion agent.

Phosphorus can form an effective barrier against corrosion without sulfur, but the addition of sulfiding agents to the process stream containing phosphorus yields a film composed of both sulfides and phosphates. This results in improved performance as well as a decreased phosphorus requirement. This invention pertains to the deliberate addition of sulfiding agents to the process stream when phosphorus-based materials are used for corrosion control to accentuate this interaction.

Phosphorous Thioacid Ester of (Babaian-Kibala, U.S. Pat. No. 5,552,085), organic phosphites (Zetlmeisl, U.S. Pat. No. 4,941,994), and phosphate/phosphite esters (Babaian-Kibala, U.S. Pat. No. 5,630,964), have been claimed to be effective in hydrocarbon-rich phase against naphthenic acid corrosion. However, their high oil solubility incurs the risk of distillate side stream contamination by phosphorus.

Phosphoric acid has been used primarily in aqueous phase for the formation of a phosphate/iron complex film on steel surfaces for corrosion inhibition or other applications (Coslett, British patent 8,667, U.S. Pat. Nos. 3,132,975, 3,460,989 and 1,872,091). Phosphoric acid use in high temperature non-aqueous environments (petroleum) has also been reported for purposes of fouling mitigation (U.S. Pat. No. 3,145,886).

There remains a continuing need to develop additional options for mitigating the corrosivity of acidic crudes at lower cost. This is especially true at times of low refining margins and a high availability of corrosive crudes from sources such as Europe, China, or Africa, and India. The present invention addresses this need.

In view of above, there is a need to provide alternative composition to provide effective high temperature naphthenic acid corrosion inhibition, which will overcome the disadvantages of the prior-art compositions.

OBJECTS AND ADVANTAGES OF THE INVENTION

Accordingly, an object of the present invention is to provide an alternative chemical composition to provide effective high temperature naphthenic acid corrosion inhibition.

Another object of present invention is to provide an additive having chemical composition which has low phosphorous contents, high thermal stability and low acidity.

Other objects and advantages will become clear after going through the detailed description of invention.

SUMMARY

The present invention comprises a new additive which is effective in inhibiting acid corrosion comprising polymeric thiophosphate ester, which is obtained by reaction of a polymer compound having mono, di or poly hydroxyl group, preferably polymer compound which is hydroxyl-terminated, more preferably said polymer compound comprising hydroxyl-terminated polyisobutylene or polybutene, with phosphorous pentasulphide. Said polymeric thiophosphate ester is further reacted with any one of the oxides selected from the group consisting of ethylene oxide, butylene oxide or propylene oxide or such other oxide, preferably ethylene oxide, capably forming ethylene oxide derivative of polymeric thiophosphate ester. The invention is useful in effecting acid corrosion inhibition on the metal surfaces of a distillation unit, distillation column, trays, packing and pump around piping.

DESCRIPTION OF THE INVENTION

The present invention uses the following reacted compound to be used as corrosion inhibitor for inhibiting high temperature naphthenic acid corrosion. This reacted compound working as effective corrosion inhibitor is obtained by reaction of a polymer compound having mono, di or poly hydroxyl group, preferably hydroxy-terminated polymer compound, more preferably hydroxyl-terminated polyisobutylene (PIB) compound or polybutene with phosphorous pentasulphide, resulting into formation of thiophosphate ester, which is polyisobutylene thiophosphate ester when polyisobutylene is used as a polymer.

The effect of corrosion inhibition is also achieved by a compound obtained by further reacting polyisobutylene thiophosphate ester with any oxide selected from group consisting of ethylene oxide, butylene oxide or propylene oxide, preferably capably forming ethylene oxide derivative of polymeric thiophosphate ester.

Conventional PIBs and so-called "high-reactivity" PIBs (see for example patent EP-B-0565285) are suitable for use in this invention. High reactivity in this context is defined as a PIB wherein at least 50%, preferably 70% or more, of the terminal olefinic double bonds are of the vinylidene type, for example the GLISSOPAL compounds available from BASF.

In one aspect, the polymer used for preparing hydroxy-terminated polymer has between 40 and 2000 carbon atoms.

In another aspect the abovementioned polymer has molecular weight of from 500 to 10000 dalton, preferably from 800 to 1600 dalton and more preferably from 950 to 1300 dalton.

The mole ratio of $P_2S_5$ to hydroxyl-terminated polymer is preferably 0.01 to 4 mole of $P_2S_5$ to 1 mole of hydroxyl-terminated polymer.

The mole ratio of $P_2S_5$ to PIB hydroxyl-terminated ester is preferably 0.01 to 4 mole of $P_2S_5$ to 1 mole of hydroxyl-terminated PIB ester. The PIB can be normal or highly reactive.

It has been surprisingly discovered by the inventor of the present invention, that a polymer based thiophosphate ester, having low phosphorus content, low acidity and high thermal stability, and non-fouling nature gives very effective control of napthenic acid corrosion.

The novel additive of the present invention is made in four basic steps.

1. High reactive PIB (Polyisobutylene) is reacted with Maleic Anhydride to make Polyisobutylene succinic anhydride (PIBSA)
2. The resultant reaction-compound of step No. 1 is further reacted with ethylene glycol to give a polymer having hydroxyl end groups which is hydroxyl-terminated polyisobutenyl succinate ester.

Depending on the mole ratio of PIBSA and ethylene glycol, Mono ester or diesters are formed which leads to the formation of mono hyrdoxy or di hydroxy terminated polymer, respectively. Both these compound are found to be useful in this invention.

Other glycols or polyols or polymeric alcohols can also be used in place of ethylene glycol. The examples of such useable compounds are propylene glycol, butane diol, butylenes glycol, butene diol, glycerine, trimethylol propane, triethylene glycol, pentaerythritol, polyethylene glycol, polypropylene glycol or any other hydroxyl terminated compounds. (This is one of the many ways of obtaining the hydroxyl-terminated polymer)

3. The resultant reaction-compound of step no. 2 is then reacted with phosphorus pentasulfide. The reaction can be carried out by using various mole ratios of hydroxyl-terminated polymer, for example, of PIB-ester of step 2 above with phosphorus pentasulfide. The resultant reaction compound obtained after completing step no. 3 is Thiophosphate ester of polyisobutenyl succinate ester. (The resulting reaction compound is effective in the present invention in inhibition of napthenic acid corrosion).
4. The resultant reaction-compound, obtained after completing step-3 is further reacted with oxides like ethylene oxide. The other common oxides like butylene oxide or propylene oxide also can be used in place of ethylene oxide. The resultant reaction compound obtained after completion of step-4 is ethylene oxide treated derivative of polyisobutylene thiophophate ester. This resulting reaction compound of step 4 is also effective in the present invention in inhibition of naphthenic acid corrosion.

It should be noted that the above mentioned steps can be understood better by referring to the corresponding examples 1, 2, 4, and 5.

The above mentioned steps describe only one illustrative example of the method of preparing invention compound. The hydroxyl-terminated polymer described in these steps can also be obtained by other appropriate methods.

The present invention is directed to a method for inhibiting corrosion on the metal surfaces of the processing units which process hydrocarbons such as crude oil and its fractions containing naphthenic acid. The invention is explained in details in its simplest form wherein the following method steps are carried out, when it is used to process crude oil in process units such as distillation unit. Similar steps can be used in different processing units such as, pumparound piping, heat exchangers and such other processing units.

These method steps are explained below:

a) heating the hydrocarbon containing naphthenic acid to vaporize a portion of the hydrocarbon:
b) allowing the hydrocarbon vapors to rise in a distillation column;
c) condensing a portion of the hydrocarbon vapours passing through the distillation column to produce a distillate;
d) adding to the distillate, from 1 to 2000 ppm, preferably from 2 to 200 ppm, of polymeric Thiophosphate ester or its oxide-treated derivatives or combination thereof, which is the required additive of present invention;
e) allowing the distillate containing compound of step (d) to contact substantially the entire metal surfaces of the distillation unit to form protective film on such surface, whereby such surface is inhibited against corrosion.

It is advantageous to treat distillation column, trays, pumparound piping and related equipment to prevent naphthenic acid corrosion, when condensed vapours from distilled hydrocarbon fluids contact metallic equipment at temperatures greater than 200° C., and preferably 400° C. The additive is generally added to the condensed distillate and the condensed distillate is allowed to contact the metallic surfaces of the distillation column, packing, trays, pump around piping and related equipment as the condensed distillate passes down the column and into the distillation vessel. The distillate may also be collected as product. The corrosion inhibitors of the instant invention remain in the resultant collected product.

In commercial practice, the additives of this invention may be added to a distillate return to control corrosion in a draw tray and in the column packing while a second injection may be added to a spray oil return immediately below the draw trays to protect the tower packing and trays below the distillate draw tray. It is not so critical where the additive of the invention is added as long as it is added to distillate that is later returned to the distillation vessel, or which contact the metal interior surfaces of the distillation column, trays, pump around piping and related equipments.

The method of using the additive compound of the present invention for achieving inhibition of high temperature naphthenic acid corrosion is explained below with the help of examples and tables.

Thus it is seen that the additive compound of present invention used for corrosion-inhibition has the following important distinguishing features, as compared to the prior art.

1) The inventor of the present invention, after extensive experimentation, has surprisingly found that the additive compound used by the inventor, is the POLYMERIC ADDITIVE, which is highly effective in high temperature corrosion inhibition, as shown by the experimental results given in Tables 1 to 7. The prior-art does not teach or suggest use of, a polymeric thiophosphate ester or oxide-treated derivative thereof, additive in naphthenic acid corrosion inhibition or sulphur corrosion inhibition or any corrosion inhibition, in general.
2) Another distinguishing feature of the additive compound of present invention is that it has more thermal stability as compared to the additive compounds taught by the prior-art, due to the polymeric nature of the additive compound of present invention. Due to its high thermal stability the additive compound of present invention is very effective in high temperature naphthenic corrosion inhibition or high temperature sulphur corrosion inhibition.
3) Yet another distinguishing feature of the additive compound of present invention is that, it has very low acidity as compared to the additive compounds of prior art, for example, the phosphate esters of prior art has very high acidity. The phosphate esters of prior art are known to have a tendency to decompose, even at lower temperatures, to form phosphoric acids, which travel further along the hydrocarbon stream and react with metal surfaces of equipments such as packing of distillation column, to form solid iron phosphate or iron sulphide. These solids plug the holes of equipments and thereby lead to fouling of distillation column. The additive compound of the present invention does not have this deficiency.
4) Further distinguishing feature of the present invention is effective inhibition by the invention additive with even low phosphorus content.

Example 1

Synthesis of Polyisobutenyl Succinate Ester (PIB Ester-Hydroxyl Terminated Polymer Compound)

Step 1: Polyisobutenyl succinic anhydride

| | Details of compound | % wt |
|---|---|---|
| 1 | HRPIB (OLOA 16500) | 89.48 |
| 2 | Maleic anhydride | 10.52 |
| | Total size | 100.00 |

Procedure

1. HRPIB (High Reactive Polyisobutylene) was charged into a clean and dry, four necked flask, equipped with nitrogen inlet, stirrer and thermometer.
2. Temperature was raised to 125° C.
3. $N_2$ gas bubbling was started and continued for 10 minutes.
4. Rate of $N_2$ gas bubbling was reduced and, sample for moisture content was taken.
5. Maleic anhydride was added to the flask.
6. After addition of maleic anhydride, temperature was raised to 170° C. and maintained for 2 hours with nitrogen bubbling.

7. After completion of maintaining of step 6 period, temperature was further raised to 205° C. and, heated at such a rate that it should reach—205° C. from 170° C. in 3 hours (5° C./25 min).
8. The reaction mixture was then maintained for 6 hours at 205° C.
9. After end of 6 hours (at 205° C.) the reaction mixture was cooled to 170° C.
10. Vacuum was slowly applied and then temperature was raised to 205° C.
11. At 205° C. vacuum was continued (below 10 mm Hg). After 2 hours sample 1 was taken for estimating acid value and free maleic acid and after 3 hours sample 2 was taken for acid value and free maleic aid.

The acid value of the product was between desired range of 70 to 120 mg KOH/g

Step II: PIB Ester

| | Details of compound | % wt | Remarks |
|---|---|---|---|
| 1 | Reaction product of step 1 | 79.899 | Sample diluted on Toluene to 85% strength |
| 2 | Mono ethylene glycol | 20.101 | |
| | Total size | 100.00 | |

Procedure

1. Resultant product obtained at the end of step 1 was diluted in toluene to 85% strength and mono ethylene glycol were charged into a clean and dry four necked flask equipped with nitrogen inlet, stirrer and thermometer.
2. Temperature was raised to 190° C. (Toluene and water were removed to reach the temperature) with nitrogen gas bubbling.
3. Reaction was maintained at 190° C. till the required acid value was obtained.

(The desired acid value should be preferably less than 5 mg KOH/g)

Example 2

Synthesis of Polymeric Thiophosphate Ester (Invention-Compound) Obtained by Reaction of Compound of Step II of Example 1 (with Various Mole Ratios) with Phosphorous Pentasulphide (with Various Phosphorous Contents)

General Procedure for Making Polymeric Thiosulphate Ester

1. PIB ester was charged into a clean and dry four necked flask equipped with nitrogen inlet, stirrer and thermometer and, temperature was raised to 90° C. with nitrogen gas bubbling
2. Phosphorus pentasulfide was added at 90° C. slowly in one lot
3. After addition of phosphorus pentasulfide temperature was raised to 120° C.
4. Reaction mixture was maintained for 1 hour at 120° C.
5. After 1 hour at 120° C., temperature was slowly raised to 140° C. and maintained for 1 hour. Then it was cooled to 90° C.
6. Acid value of the as sample was measured as (45.61 mgKOH/g)
7. The reaction mixture was diluted with 1:1 Toluene
8. Temperature was raised to reflux point, nitrogen gas bubbling was started and continued for 6 hours.
9. The reaction mixture was cooled and filtered through hyflow at 60° C.
10. The reaction mixture was diluted to 50% by weight in solvent.

(2-A) Reaction of PIB Ester with Phosphorus Pentasulfide (Phosphorous Content in the Final 100% Active Product P—3.156%)

| | Details of compound | % wt | Remarks |
|---|---|---|---|
| 1 | PIB Ester obtained after completion of step II of Example 1 | 88.701 | EXAMPLE 1 STEP II |
| 2 | phosphorus pentasulfide | 11.299 | |
| | Total weight | 100.00 | |

(2-B) (Phosphorous Content in the Final 100% Active Product P—4.47%)

| | Details of compound | % wt | Remarks |
|---|---|---|---|
| 1 | PIB Ester | 83.981 | EXAMPLE 1 STEP II |
| 2 | phosphorus pentasulfide | 16.019 | — |
| | Total weight | 100.00 | |

Acid value was between 64 and 73 mgKOH/g (Typically acid value ranges from 40 to 190 mg/g KOH)

(2-C) (Phosphorous Content in the Final 100% Active Product P—7.715)

| | Details of compound | % wt | Remarks |
|---|---|---|---|
| 1 | PIB Ester | 72.374 | EXAMPLE 1 STEP 2 |
| 2 | phosphorus pentasulfide | 27.626 | — |
| | Total weight | 100.00 | |

Acid value was 109.65 mgKOH/g (Typically acid value ranges from 90 to 190 mg KOH/g)

Example 3

High Temperature Naphthenic Acid Corrosion Test

In this example, various amounts of a 50% formulation of the composition prepared in accordance, with Examples 1 to 3, were tested for corrosion inhibition efficiency on carbon steel coupons in hot neutral oil containing naphthenic acid. A weight loss coupon, immersion test was used to evaluate the invention compound for its effectiveness in inhibition of naphthenic acid corrosion at 290° C. temperature. Different dosage such as 300, 400 and 600 ppm of invention compound were used, as 50% active solution.

A static test on carbon steel coupon was conducted without using any additive. This test provided a blank test reading.

The reaction apparatus consisted of a one-liter four necked round bottom flask equipped with water condenser, $N_2$ purger tube, thermometer pocket with thermometer and stirrer rod. 600 g (about 750 ml) paraffin hydrocarbon oil (D-130-fraction of higher than 290° C.) was taken in the flask. $N_2$ gas purging was started with flow rate of 100 cc/minute and the temperature was raised to 100° C., which was maintained for 30 minutes.

An additive compound of (2-A) in example 2 was added to the reaction mixture. The reaction mixture was stirred for 15 minutes at 100° C. temperature. After removing the stirrer, the temperature of the reaction mixture was raised to 290° C. A pre-weighed weight-loss carbon steel coupon CS 1010 with dimensions 76 mm . . . times 13 mm . . . times 1.6 mm was immersed. After maintaining this condition for 1 hour to 1.5 hours, 31 g of naphthenic acid (commercial grade with acid value of 230 mgKOH/g was added to the reaction mixture. A sample of one g weight of reaction mixture was collected for determination of acid value, which was found to be approximately 11.7 mgKOH/g. This condition was maintained for four hours. After this procedure, the metal coupon was removed, excess oil was rinsed away, the excess corrosion product was removed from the metal surface. Then the metal coupon was weighed and the corrosion rate was calculated in mils per year. Similar method of testing was used for each of the additive compounds of (2-B) and (2-C) of example 2, prior-art-additive of example 4 and ethylene-oxide-treated additives of (2-B) and (2-C) of example 2. The test results are presented in Tables 1 to 5-A. Similar studies were conducted for ethylene-oxide-treated additives of example 2, in which the passivation time was 4 hours and the duration of the test was 24 hours. The test results are shown in the Table 5-B.

Calculation of Corrosion Inhibition Efficiency

The method used in calculating Corrosion Inhibition Efficiency is given below. In this calculation, corrosion inhibition efficiency provided by additive compound is calculated by comparing weight loss due to additive with weight loss of blank coupon (without any additive).

The corrosion rate in MPY (mils per year) is calculated by the formula, $$MPY = \frac{534 \times \text{Weight loss in mg}}{(\text{Density in gm/cc}) \times (\text{Area in in}^2) \times (\text{Time of test in hours})}$$

$$\text{Corrosion Inhibition Efficiency} = \frac{(\text{Weight loss for blank without additive}) - (\text{weight loss with additive})}{(\text{weight loss for blank without additive})} \times 100$$

The calculated magnitudes are entered in the Tables in appropriate columns.

The results of the experiments are presented in Tables 1, 2 and 3.

TABLE 1

Phosphorous Content P = 3.145% (Duration of test 4 hours)

| Expt. No. | Compound | Dosage in Ppm | Effective Dosage in ppm | Weight Loss in mg | Corrosion Rate MPY | Corrosion Inhibition Efficiency |
|---|---|---|---|---|---|---|
| 1 | Blank | — | — | 89 | 445 | — |
| 2 | Resultant product of 2-A of example 2 | 600 | 300 | 1.8 mg | 9 | 97.97 |

TABLE 2

Phosphorous Content P = 4.47% (Duration of test 4 hours)

| Expt. No. | Compound | Dosage in Ppm | Effective Dosage in ppm | Weight Loss in mg | Corrosion Rate MPY | Corrosion Inhibition Efficiency |
|---|---|---|---|---|---|---|
| 1 | Blank | — | — | 89 | 445 | — |
| 3 | Resultant product of 2-B of example 2 | 300 | 150 | 24.7 | 123 | 72.4 |

The experiments were conducted with different contents of phosphorous in the final 100% active product as per Example 2 with the results being presented in Table 1 to 3. It is seen that with phosphorous content of 3.145% the corrosion inhibition efficiency was 97.97% for effective dosage of inhibitor compound as 300 ppm. When the phosphorous content was increased to 7.75% and effective dosages were reduced to 200 ppm and 150 ppm, the corrosion inhibition efficiency was 99.6% and 95.84% respectively.

TABLE 3

Phosphorous content P = 7.75% (Duration of test 4 hours)

| Expt. No. | Compound | Dosage in Ppm | Effective Dosage in ppm | Weight Loss in mg | Corrosion Rate MPY | Corrosion Inhibition Efficiency |
|---|---|---|---|---|---|---|
| 1 | Blank | — | — | 89 | 445 | — |
| 4 | Resultant product of 2-C of example 2 | 400 | 200 | 0.4 | 2 | 99.6 |
| 5 | Resultant product of 2-C of example 2 | 300 | 150 | 3.7 | 18.5 | 95.84 |

The Effect of Invention Compound (Polymeric Thiophosphate Ester Non Ethylene Oxide Treated) on the Naphthenic Acid Corrosion Inhibition. 4 Hours Test Duration

| Experiment no | Compound | Effective dosage in ppm | Total phosphorus content in ppm | Corrosion inhibition efficiency in % |
|---|---|---|---|---|
| 2 | Resultant product of 2-A of example 2 Phosphrous content 3.145% (invention compound) | 300 | 3.145 × 3.00 = 9.435 | 97.97 |
| 5 | Resultant product of 2-C of example 2 Phosphrous content 7.75% (invention compound) | 150 | 7.75 × 1.50 = 11.625 | 95.84 |

-continued

| Experiment no | Compound | Effective dosage in ppm | Total phosphorus content in ppm | Corrosion inhibition efficiency in % |
|---|---|---|---|---|
| 8 | Resultant product of example 4 Phosphorous content 9.75% (prior art) | 150 | 9.75 × 1.5 = 14.625 | 89.88 |

The results of use of effective dosages of additives from Table 1, Table 3, and Table 4 are compared in a tabular form given above. It is clearly seen that, in comparison with the prior art compound, with the same effective dosage of 150 ppm, the invention compound (example 2, experiment 5 in the above table, polymeric thiophosphate ester non ethylene oxide treated) provides higher corrosion inhibition efficiency of 95.84% with lower total phosphorous content of 11.625 ppm as compared to the efficiency of 89.88% with higher total phosphorous content of 14.625 ppm for prior art compound (octyl thiophosphate ester–Non polymeric additive, experiment no 8 in the above table).

By doubling the effective dosage of the above invention compound (example 2 experiment no 2 in the above table—polymeric thiophosphate ester) to 300 ppm it is observed that still higher corrosion inhibition efficiency of 97.97% is obtained with much lower total phosphorous content of 9.435 ppm.

It is well known to the person skilled in the art that use of higher phosphorous content compounds as corrosion inhibitors has been claimed to affect the function of various catalyst used to treat crude oil such as fixed bed hydrotreaters and hydrocracking units. These higher phosphorous compounds also act as poison for the catalyst. Another disadvantage of the non polymeric additive is that they tend to break down at higher temperature conditions giving out volatile products which tend to contaminate the other hydrocarbon streams.

The above discussion clearly shows the advantage of use of invention compound over prior art compound for naphthenic acid corrosion inhibition.

Example 4

Synthesis of Octyl Thiophosphate Ester (Non-Polymeric Thiophosphate Ester as Anticorrosion Compound of Prior Art (U.S. Pat. No. 5,552,085)

The clean four-necked-flask was equipped with stirrer, nitrogen gas inlet and condenser. N-noctanol weighing 400 g was charged in the flask. Phosphorous pentasulphide weighing 187 g, was then added to the flask in installments. The temperature of the flask was then increased to 110° C. The $H_2S$ gas was seen to be evolved after addition of $P_2S_5$. After one hour, the reaction mixture in the flask was heated to 140° C. and the flask was maintained at that temperature for one hour. The sample was cooled and filtered through 5 micron filter. The sample was heated to 90° C. The nitrogen gas was purged for 5 hours. The resulting sample, that is compound B2 was analyzed for its acid value, which was found to be between 110 to 130 mg/KOH. This compound was tested for its naphthenic acid corrosion efficiency. The corrosion inhibition efficiency is calculated as per method given in Example 3 and results of experiments are presented in table 4.

TABLE 4

Octyl thiophosphate ester Non - polymeric thiophosphate ester as anticorrosion compound of prior art. Phosphrous content P = 9.75% (Duration of test 4 hours)

| Experiment No. | Compound | Dosage in ppm | Effective dosage in ppm | Weight loss in mg | Corrosion Rate MPY | Corrosion inhibition Efficiency |
|---|---|---|---|---|---|---|
| 1 | Blank | — | — | 89 | 445 | — |
| 6 | Example 4 | 90 | 45 | 45 | 225 | 49.43 |
| 7 | Example 4 | 180 | 90 | 22 | 110 | 75.28 |
| 8 | Example 4 | 300 | 150 | 9 | 45 | 89.88 |

Example 5

Synthesis of Ethylene Oxide Derivatives

The ethylene oxide derivatives of polymeric thiophosphate ester of polyisobutylene succinate ester were prepared as using below described procedure:

Procedure

The additive compound, which is the resultant product of 2-C of example 2, was transferred to the autoclave and ethylene oxide is added at 60° C. to 70° C., till the pressure in the autoclave remained constant. The reaction mixture was maintained at that temperature for 2 hours. The reaction mixture was cooled and the autoclave was flushed with nitrogen. The resultant additive, that is, ethylene oxide treated thiophosphate ester of polyisobutylene succinate ester, was used as additive for napthenic acid corrosion inhibition. The similar synthesis was carried out by using resultant product of 2-B of example 2. The weight percentages for 2-B, 2-C, and ethylene oxide are given below.

Example (5-A)

Ethylene Oxide Derivative of (2-C) of Example 2

| | Details of compound | % wt |
|---|---|---|
| 1 | Resultant Product of 2-C | 44.1 |
| 2 | Ethylene oxide | 15.1 |
| 3 | Aromatic Solvent | 40.8 |

Example (5-B)

Ethylene Oxide Derivative of (2-B) of Example 2

| | Details of compound | % wt |
|---|---|---|
| 1 | Resultant Product of 2-B | 45.4 |
| 2 | Ethylene oxide | 15.4 |
| 3 | Aromatic Solvent | 39.2 |

It was noted that the acid value of resultant product 2-C used in the above mentioned synthesis process was 87.2 mg KOH/gm, whereas the acid values of ethylene oxide reacted product was 16 mg/gKOH. Similarly, the acid value of resultant product 2-B used in the above mentioned synthesis process was 56.8 mg KOH/gm, whereas the acid value of corresponding ethylene oxide reacted product was 3.98 mg KOH/g. Both these synthesis examples point to the desirable low-acid-values of the final products after synthesis is completed.

The corrosion-inhibition-tests for these synthesized additive products were conducted as per procedure given in Example 3 (4 hours and 24 hours test duration) and test results are presented in Table 5-A and Table 5-B, respectively.

TABLE 5-A

Corrosion inhibition studies (static) for 4 hrs test duration.

| Experiment No | Details of compound | Active Dosage ppm | Mg loss after test | MPY after test | % efficiency after test |
|---|---|---|---|---|---|
| 1 | Blank | — | 89 | 445 | — |
| a | Invention compound as per example 5-A | 150 | 2.1 | 10.5 | 97.60 |
| b | Invention compound as per example 5-A | 90 | 17 | 85 | 80.89 |
| c | Invention compound as per example 5-B | 120 | 14.9 | 72.5 | 90.44 |

Note:

It can be seen from the results presented in Table 5-A, that the ethylene oxide derivative of the polymeric thiophosphate ester is also very effective in acid corrosion inhibition, as compared to results of Table 4 for prior-art-compound.

TABLE 5-B

Corrosion inhibition studies (static) for 24 hrs test duration.

| Experiment No | Details of compound | Active Dosage ppm | Mg loss after test | MPY after test | % efficiency after test |
|---|---|---|---|---|---|
| 9 | Blank | — | 313 | 261 | — |
| 10 | Prior-art-additive (as per example-4) | 300 | 88.5 | 73.8 | 71.7 |
| 11 | Invention compound (as per example 2-B) | 450 | 65 | 54.2 | 79.2 |
| 12 | Invention compound (as per example 2-C) | 300 | 130 | 108.5 | 58.5 |
| 13 | Invention compound (as per example 2-B) | 300 | 135 | 112.6 | 60.4 |
| 14 | Invention compound (as per example 5-A) | 300 | 11 | 9.2 | 96.5 |
| 15 | Invention compound (as per example 5-B) | 300 | 22.4 | 18.7 | 92.8 |

Comparison of Effects of Invention Compound—Polymeric Thiophosphate Ester (with and without Ethylene Oxide Treatment) on Naphthenic Acid Corrosion Inhibition—24 Hours Test Duration

| Expt. No | Compound | Effective dosage in ppm | Total phosphorous content in ppm | Corrosion Inhibition in % |
|---|---|---|---|---|
| 10 | Prior-art-additive (as per example 4) (9.75) | 300 | 9.75 × 3 = 29.25 | 71.7 |
| 11 | Invention compound (as per example 2-B) (4.47) | 450 | 4.47 × 4.5 = 20.115 | 79.2 |
| 12 | Invention compound (as per example 2-C) (7.715) | 300 | 7.715 × 3 = 23.145 | 58.5 |
| 13 | Invention compound (as per example 2-B) (4.47) | 300 | 4.47 × 3 = 13.41 | 60.4 |

-continued

| Expt. No | Compound | Effective dosage in ppm | Total phosphorous content in ppm | Corrosion Inhibition in % |
|---|---|---|---|---|
| 14 | Invention compound (as per example 5-A) (5.49) | 300 | 5.49 × 3 = 16.47 | 96.5 |
| 15 | Invention compound (as per example 5-B) (3.15) | 300 | 3.15 × 3 = 9.45 | 92.8 |

Note:
Invention compound is polymeric thiophosphate ester prepared by following steps given in example 2 and example 5. The values in the bracket indicates the phosphrous content of the inventive compound in percentage.

The results of the use of effective dosages of example 5 are compared above in a tabular form with specific references to the total phosphorous content and efficiency of the corrosion inhibition.

Comparing the results of experiment numbers 10, 12 and 14, of Table 5-B the surprising favorable technical effect of the ethylene oxide derivative of polymeric thiophosphate ester is clearly seen from much higher efficiency of 96.5% and much lower phosphorous content of 16.47 ppm (after ethylene oxide treatment) as compared to the efficiency of 58.5% and phosphorus content of 23.145 ppm (before ethylene oxide treatment) and efficiency of 71.7% and phosphorous content 29.25 ppm of prior art compound.

Similarly comparing results of experiment 10, 13, and 15, of Table 5-B the surprising favorable technical effect of ethylene oxide treatment of polymeric thiophosphate ester is clearly seen with much higher efficiency of 92.8% and much lower phosphorous content of 9.45 ppm (after ethylene oxide treatment) as compared to the efficiency of 60.4% and phosphorous content 13.14 ppm (before ethylene oxide treatment) efficiency of 71.7% and phosphorous content 29.25 ppm of prior art compound.

The person skilled in the art should be aware of the surprising favorable technical effect mentioned above.

It is well known to the person skilled in the art that use of higher phosphorous content compounds as corrosion inhibitors has been claimed to affect the function of various catalyst used to treat crude oil such as fixed bed hydrotreaters and hydrocracking units. These higher phosphorous compounds also act as poison for the catalyst. Another disadvantage of the non polymeric additive is that they tend to break down at higher temperature conditions.

The above discussion clearly shows the advantage of use of invention compound over prior art compound for naphthenic acid corrosion inhibition.

Example 6

High Temperature Naphthenic Acid Corrosion Inhibition (Dynamic Test)

The dynamic testing was carried out by using rotating means provided in the temperature-controlled autoclave and was carried out by using passivated steel coupons. A dynamic test on steel coupon was conducted without using any additive. This test provided a blank test reading. The passivation procedure is explained below:

400 g of paraffin hydrocarbon oil (D-130) was taken in a autoclave. A pre-weighed weight-loss coupon CS 1010 with dimensions 76 mm . . . times 13 mm . . . times 1.6 mm was fixed to the stirrer of the autoclave. This was then immersed in the oil. N2 gas was purged. While carrying out passivation of steel coupon in separate dynamic tests, each of the invention compounds of examples 2-B, 5-A and prior-art-additive of example 4 is added separately, in each separate test, to the reaction mixture (and each final dynamic test carried out separately). The reaction mixture was stirred for 15 minutes at 100° C. temperature. Then autoclave blanketing with 1 kg/cm$^2$ by nitrogen was carried out. The temperature of the reaction mixture was raised to. After maintaining this condition for 4 hours, the autoclave was cooled and the coupons were removed and rinsed to remove the oil and then dried. This formed the pre-passivated coupon. The dried coupon was then fixed to the stirrer again.

The oil used for the passivation was removed and 400 g fresh oil containing 6.2 g of commercial napthenic acid (TAN VALUE 230 mgKOH/g) was added to the autoclave. The resultant TAN of the system was 3.5 mgKOH/g. The temperature of the autoclave was then raised to 315° C. and maintained at this temperature for 24 hrs. Example 1 to 3, were tested dynamically for corrosion inhibition efficiency on steel coupons in a hot oil containing naphthenic acid.

The following test equipment and materials were used in the Dynamic Corrosion Test:

1. Temperature controlled autoclave
2. Preweighed weight-loss carbon steel coupons CS 1010 with dimensions 76 mm . . . times 13 mm . . . times 1.6 mm.
3. Means to rotate the coupon, to provide a peripheral velocity in excess of 3 m/second.

After the test, the coupons were removed, excess oil was rinsed away, excess corrosion product was removed from the surface of coupons. The coupons were then weighed and the corrosion rate was calculated as mils/year. The results of this dynamic test are presented in Table 6.

TABLE 6

High Temperature Naphthenic Acid Corrosion inhibition (Dynamic Test).

| Experiment No. | Details of compound | Active Dosage ppm | Mg loss after test | MPY after test | % efficiency after test |
|---|---|---|---|---|---|
| 16 | Blank | — | 61.2 | 51.1 | — |
| 17 | Prior art additive as per example 4 | 500 | 2.9 | 2.42 | 95.26 |
| 17-A | Prior art additive as per example 4 | 250 | 15.1 | 12.6 | 75.3 |

TABLE 6-continued

High Temperature Naphthenic Acid Corrosion inhibition (Dynamic Test).

| Experiment No. | Details of compound | Active Dosage ppm | Mg loss after test | MPY after test | % efficiency after test |
|---|---|---|---|---|---|
| 17-B | Invention compound as per example 5-A | 250 | 0.45 | 0.38 | 99.25 |
| 18 | Invention compound as per example 2-B | 500 | 0.85 | 0.71 | 98.6 |

Example 7

Thermal Analysis

The thermal analysis test of the invention compounds and the prior art compound were carried out in the Mettler Toledo Thermo Gravimetric Analyzer. A known weight of the sample was heated in the analyzer from 35° C. to 600° C. at a rate of 10° C./minute under nitrogen atmosphere. The temperature at which 50% loss in weight of sample occurs is taken as the representative of thermal stability. The weight of the residue obtained at 600° C., and the temperature at 50% weight loss are presented in Table 7. The weight of the residue is indicative of the tendency of the additive, to deposit at high temperature zones of equipments like furnaces, which may cause fouling of the equipment in due course.

TABLE 7

Thermal Analysis data

| Experiment No | Details of compound | Temperature at 50% loss | Residue at 600 deg C. |
|---|---|---|---|
| 19 | Invention compound as per example 2-C | 393 | 21.2975 |
| 20 | Invention compound as per example 2-B | 386 | 12.9567 |
| 21 | Invention compound as per example 5-A | 395 | 12.8771 |
| 22 | Invention compound as per example 5-B | 391 | 6.8389 |
| 23 | Prior-art-additive as per example 4 | 220 | 23.5795 |

Discussion about Thermal Stability

It can be seen from the above table that the invention compounds (experiment No 19 to experiment No 22) the temperature of 50% weight loss varies from 386° C. to 395° C. The invention compounds in the above table include Non EO treated and the EO treated derivative. These values are much higher when compared with the prior additive which has a value of only 220° C. These clearly indicates the higher thermal stability of the invention compounds when compared with the prior art compound. It is known to the person skilled in the art that it is desirable to have additives with higher thermal stability since these will not decompose to volatile products leading to fouling and contamination of other streams. The other advantage of thermally stable compound is they retain their corrosion inhibition efficiency at higher temperatures.

It is also seen from the above table that it is advantageous to treat the invention compound further with ethylene oxide. EO treatment reduces phosphorous content and also the residue at 600° C. It is seen from the above table that the invention compounds leave much lower residues at 600° C. The residue obtained for the invention compounds (experiment 20 to 22 in the above table) is much lower than the prior additive which is 23.5% (experiment no 23 in the above table). The above data clearly indicates that the invention compounds will have least deposition tendency in the areas of furnace.

It is apparent from the foregoing discussion that the present invention comprises the following items:

1. An additive for inhibiting acid corrosion comprising polymeric thiophosphate ester, which is obtained by reaction of a polymer compound having mono, di or poly hydroxyl group, preferably polymer compound which is hydroxyl-terminated, more preferably said polymer compound comprising hydroxyl terminated polyisobutylene or polybutene, with phosphorous pentasulphide.
2. An additive, as described in item 1, wherein said polymeric thiophosphate ester is further reacted with any one oxide selected from group consisting of ethylene oxide, butylene oxide or propylene oxide or such other oxide, preferably ethylene oxide, capably forming ethylene oxide derivative of said polymeric thiophosphate ester.
3. An additive, as described in items 1 and 2, wherein said polymer compound has from 40 to 2000 carbon atoms.
4. An additive, as described in items 1 and 2, wherein said polymer compound has molecular weight of from 500 to 10000 dalton, preferably from 800 to 1600 dalton and more preferably from 950 to 1300 dalton.
5. An additive, as described in items 1 and 2, wherein mole ratio of said phosphorous pentasulphide to said polymer compound which is hydroxyl-terminated is preferably 0.01 to 4 moles to 1 mole respectively.
6. An additive, as described in items 1, wherein said polyisobutylene is normal or high reactive.
7. An additive, as described in items 1 and 2, wherein the effective dosage of said additive is from 1 ppm to 2000 ppm, preferably from 2 ppm to 200 ppm.
8. A method of making a new additive for inhibiting acid corrosion, said additive comprising polymeric polyisobutylene thiophosphate ester, comprising the steps of:
   (a) reacting high reactive polyisobutylene with maleic anhydride, capably forming polyisobutylene succinic anhydride.
   (b) reacting said polyisobutylene succinic anhydride of step (a) with glycols or polyols or polymeric alcohols, preferably propylene glycol, butane diol, butylene glycol, butene diol, glycerin, trimethyl propane, polyethylene glycol, polypropylene glycol, polytetramethylene glycol, more preferably ethylene glycol, capably forming hydroxyl-terminated polyisobutenyl succinate ester;
   (c) reacting resultant reaction compound of step (b) with phosphorous pentasulphide, with various mole ratios of said hydroxyl-terminated polyisobutenyl succinic ester and phosphorous pentasulphide, capably forming thiophosphate ester of polyisobutylene succinate ester, which is acid corrosion inhibiting additive;

(d) reacting optionally resultant reaction compound of step (c) with any one oxide selected from group consisting of ethylene oxide, butylene oxide or propylene oxide preferably with ethylene oxide, capably producing ethylene oxide treated derivative of polyisobutylene thiophosphate ester, which is acid corrosion inhibiting additive.

9. A method of using a new additive for inhibiting acid corrosion, comprising the step of:

a. heating the hydrocarbon containing naphthenic acid to vaporize a portion of said hydrocarbon;

b. allowing the hydrocarbon vapors to rise in a distillation column;

c. condensing a portion of said hydrocarbon vapors passing through the distillation column to produce a distillate d. adding to the distillate from 1 to 2000 ppm, preferably 2 to 200 ppm, of polyisobutylene thiophosphate ester or ethylene oxide treated compound thereof;

e. allowing the resultant mixture of step d to contact substantially the entire metal surfaces of said distillation column capably forming protective film on said surface whereby such surfaces are inhibited against corrosion.

Although the invention has been described with reference to certain preferred embodiments, the invention is not meant to be limited to those preferred embodiments. Alterations to the preferred embodiments described are possible without departing from the spirit of the invention. However, the process and composition described above are intended to be illustrative only, and the novel characteristics of the invention may be incorporated in other forms without departing from the scope of the invention.

The invention claimed is:

1. An additive for inhibiting high temperature naphthenic acid corrosion comprising polymeric thiophosphate ester, which is reaction product of reaction of hydroxyl terminated polyisobutylene or polybutene succinate ester with phosphorous pentasulphide.

2. An additive for inhibiting high temperature naphthenic acid corrosion comprising an ethylene oxide derivative of polymeric thiophosphate ester formed by reacting polymeric thiophosphate ester with ethylene oxide, wherein said polymeric thiophosphate ester is a reaction product of reaction of hydroxyl terminated polyisobutylene or polybutene succinate ester with phosphorous pentasulphide.

3. The additive, as claimed in claim 1, wherein said hydroxyl terminated polyisobutylene or polybutene succinate ester has from 40 to 2000 carbon atoms.

4. The additive, as claimed in claim 1, wherein said hydroxyl terminated polyisobutylene or polybutene succinate ester has molecular weight varying from 500 to 10000 dalton.

5. The additive, as claimed in claim 1, wherein mole ratio of said phosphorous pentasulphide to said polymer compound which is hydroxyl-terminated is 0.01 to 4 moles to 1 mole respectively.

6. The additive, as claimed in claim 1, wherein said polyisobutylene is normal or high reactive.

7. The additive, as claimed in claim 1, wherein the effective dosage of said additive comprises the effective dosage varying from 1 ppm to 2000 ppm.

8. The additive, as claimed in claim 1, wherein said hydroxyl terminated polyisobutylene or polybutene succinate ester has molecular weight varying from 800 to 1600 dalton.

9. The additive, as claimed in claim 1, wherein said hydroxyl terminated polyisobutylene or polybutene succinate ester has molecular weight varying from 950 to 1300 dalton.

10. The additive, as claimed in claim 1, wherein the effective dosage of said additive comprises the effective dosage varying from 2 ppm to 200 ppm.

11. An additive for inhibiting high temperature naphthenic acid corrosion comprising an oxide derivative of polymeric thiophosphate ester formed by reacting polymeric thiophosphate ester with an oxide selected from the group consisting of butylene oxide and propylene oxide, wherein said polymeric thiophosphate ester is a reaction product of reaction of hydroxyl terminated polyisobutylene or polybutene succinate ester with phosphorous pentasulphide.

12. A method of making an additive for inhibiting high temperature naphthenic acid corrosion, wherein said additive comprises polymeric hydroxyl terminated polyisobutylene thiophosphate ester, and is prepared by a process comprising the steps of:

(a) reacting high reactive polyisobutylene with maleic anhydride to form polyisobutylene succinic anhydride;

(b) reacting said polyisobutylene succinic anhydride of step (a) with a compound selected from glycols or polyols or polymeric alcohols to form hydroxyl-terminated polyisobutenyl succinate ester;

(c) reacting resultant reaction compound of step (b) with phosphorous pentasulphide to form thiophosphate ester of polyisobutylene succinate ester, which is high temperature naphthenic acid corrosion inhibiting additive.

13. A method of making an additive for inhibiting high temperature naphthenic acid corrosion, wherein the additive comprises polymeric ethylene oxide treated derivative of polyisobutylene thiophosphate ester, and is produced by a process comprising the steps of:

(a) reacting high reactive polyisobutylene with maleic anhydride to form polyisobutylene succinic anhydride;

(b) reacting said polyisobutylene succinic anhydride of step (a) with a compound selected from glycols or polyols or polymeric alcohols to form hydroxyl-terminated polyisobutenyl succinate ester;

(c) reacting resultant reaction compound of step (b) with phosphorous pentasulphide to form thiophosphate ester of polyisobutylene succinate ester;

(d) reacting resultant reaction compound of step (c) with ethylene oxide to form ethylene oxide treated derivative of polyisobutylene thiophosphate ester, which is high temperature naphthenic acid corrosion inhibiting additive.

14. The method as claimed in claim 12, wherein said polyisobutylene succinic anhydride of step (a) is reacted with a compound selected from the group consisting of propylene glycol, butane diol, butylene glycol, butene diol, glycerin, trimethylol propane, polyethylene glycol, polypropylene glycol and polytetramethylene glycol.

15. The method as claimed in claim 12, wherein said polyisobutylene succinic anhydride of step (a) is reacted with ethylene glycol.

16. The method as claimed in claim 12, wherein said resultant reaction compound of step (c) is reacted with an oxide selected from the group consisting of butylene oxide and propylene oxide to form oxide derivative of said polymeric thiophosphate ester.

17. The method as claimed in claim 13, wherein said polyisobutylene succinic anhydride of step (a) is reacted with a compound selected from the group consisting of propylene glycol, butane diol, butylene glycol, butene diol, glycerin, trimethylol propane, polyethylene glycol, polypropylene glycol and polytetramethylene glycol.

18. The method as claimed in claim 13, wherein said polyisobutylene succinic anhydride of step (a) is reacted with ethylene glycol.

19. The method as claimed in claim 13, wherein said resultant reaction compound of step (c) is reacted with an oxide selected from the group consisting of butylene oxide and propylene oxide to form oxide derivative of said polymeric thiophosphate ester.

20. A method of using an additive for inhibiting high temperature naphthenic acid corrosion as claimed in claim 1, comprising the steps of:

a. heating a hydrocarbon containing naphthenic acid to vaporize a portion of said hydrocarbon;
b. allowing the hydrocarbon vapors to rise in a distillation column;
c. condensing a portion of said hydrocarbon vapors passing through the distillation column to produce a distillate;
d. adding to the distillate from 1 to 2000 ppm of the additive to form a mixture;
e. allowing the mixture of step d to contact metal surfaces of said distillation column to form protective film on said surface whereby such surfaces are inhibited against corrosion.

21. A method of using an additive for inhibiting high temperature naphthenic acid corrosion as claimed in claim 2, comprising the steps of:

a. heating a hydrocarbon containing naphthenic acid to vaporize a portion of said hydrocarbon;
b. allowing the hydrocarbon vapors to rise in a distillation column;
c. condensing a portion of said hydrocarbon vapors passing through the distillation column to produce a distillate;
d. adding to the distillate from 1 to 2000 ppm of the ethylene oxide derivative of said polymeric thiophosphate ester to form a mixture;
e. allowing the mixture of step d to contact metal surfaces of said distillation column to form protective film on said surface whereby such surfaces are inhibited against corrosion.

22. A method of using an additive for inhibiting high temperature naphthenic acid corrosion as claimed in claim 11, comprising the steps of:

a. heating a hydrocarbon containing naphthenic acid to vaporize a portion of said hydrocarbon;
b. allowing the hydrocarbon vapors to rise in a distillation column;
c. condensing a portion of said hydrocarbon vapors passing through the distillation column to produce a distillate;
d. adding to the distillate from 1 to 2000 ppm of the oxide derivative of said polymeric thiophosphate ester to form a mixture;
e. allowing the mixture of step d to contact metal surfaces of said distillation column to form protective film on said surface hereby such surfaces are inhibited against corrosion.

* * * * *